US009915496B2

(12) United States Patent
Bergeron

(10) Patent No.: US 9,915,496 B2
(45) Date of Patent: Mar. 13, 2018

(54) LIGHT GAS GUN

(71) Applicant: David Wayne Bergeron, Albuquerque, NM (US)

(72) Inventor: David Wayne Bergeron, Albuquerque, NM (US)

( * ) Notice: Subject to any disclaimer, the term of this patent is extended or adjusted under 35 U.S.C. 154(b) by 495 days.

(21) Appl. No.: 14/205,064

(22) Filed: Mar. 11, 2014

(65) Prior Publication Data

US 2016/0161212 A1 Jun. 9, 2016

Related U.S. Application Data

(60) Provisional application No. 61/778,953, filed on Mar. 13, 2013.

(51) Int. Cl.

| | |
|---|---|
| ***F41A 1/04*** | (2006.01) |
| ***F41B 11/68*** | (2013.01) |
| ***F41B 11/723*** | (2013.01) |
| ***F42B 6/10*** | (2006.01) |
| ***F41A 21/02*** | (2006.01) |
| ***F41A 21/28*** | (2006.01) |
| ***F41B 11/73*** | (2013.01) |

(52) U.S. Cl.

CPC ..... *F41B 11/68* (2013.01); *F41A 1/04* (2013.01); *F41A 21/02* (2013.01); *F41A 21/28* (2013.01); *F41B 11/723* (2013.01); *F41B 11/73* (2013.01); *F42B 6/10* (2013.01)

(58) Field of Classification Search

CPC ..... F41A 1/04; F41B 11/68; F41B 11/681; F41B 11/682

USPC ..... 89/8, 7

See application file for complete search history.

(56) References Cited

U.S. PATENT DOCUMENTS 5,429,030 A * 7/1995 Tidman ..... F41A 1/00 102/202.7

7,954,413 B2 * 6/2011 Koth ..... F41A 1/00 89/7

8,056,462 B1 * 11/2011 Lacy ..... F41B 11/62 124/73

* cited by examiner

*Primary Examiner* — Reginald Tillman, Jr.

(57) ABSTRACT

An improved light gas gun launches a projectile in a light gas atmosphere as it travels through a frictionless barrel to achieve high muzzle velocities, decreased acoustic signatures, and increased ranges. The light gas atmosphere is introduced by a purge valve prior to firing or by a muzzle valve that holds a positive light gas pressure on the barrel and breech. The muzzle valve also routes the majority of propellant gases through a suppression canister, reducing the light gas gun's acoustic signature. The frictionless barrel uses light gas propellant routed through gas bearings to keep the projectile centered in the barrel and preclude the projectile from contacting the barrel walls, eliminating barrel wear.

5 Claims, 6 Drawing Sheets

Light Gas Gun

Light Gas Gun

Barrel Section Detail
For Projectile Assembly

Barrel Section Detail
For Projectile Assembly

Muzzle Valve Assembly Detail

Breech Assembly

LIGHT GAS GUN

BACKGROUND OF THE INVENTION

Field of the Invention

This invention relates to a means for propelling a projectile at relatively high muzzle velocities using light gas as the working fluid and increasing range and lethality while minimizing visible and acoustic signatures.

Description of the Prior Art

Hypervelocity guns have been used since the late 1940s for impact and strength of materials research. These guns use light gases, primarily hydrogen, as the working fluid to propel projectiles at speed ranging from 5 to 30 thousand feet per second. Much of the development of the guns is centered on improving the light gas propellant delivery to the breech. Single stage, two stage, and three stage pistons schema have been proposed, most with the intention of ever higher muzzle velocities.

Koth, U.S. Pat. No. 7,954,413, proposes an improved two-stage light gas gun for launching projectiles at high speeds. The gun consists of three tubes: the expansion, pump, and launch tubes. The expansion tube contains a close-fitting expansion piston that is propelled by an explosive charge. The expansion piston in turn drives the pump piston housed within the pump tube by means of a rod connecting the two pistons. The action of the pump piston adiabatically compresses and heats a light gas of hydrogen or helium, bursting a diaphragm at a predetermined pressure and expelling the projectile from the launch tube at a very high speed. These combustion products can cause fouling of the pump tube, making it impractical to convert the design to a fieldable weapon system. It also uses a single use diaphragm, making rapid fire difficult.

Guthrie, et al, U.S. Pat. No. 5,303,633, proposes a shock compression jet gun with associated explosive charge assembly. The shock compression jet gun features a breech for storage of the explosive charge assembly, a projectile tube, and an expansion nozzle disposed between the breech and projectile tube. The expansion nozzle includes converging and diverging passageways. The explosive charge assembly includes a shock absorbing outer casing, a detonator, a shaped charge positioned within the casing and a compressible medium retained within a recess formed in the shaped charge. The compressible medium is maintained within the recess by way of a membrane sealing one end of the casing. In a preferred embodiment the compressible medium is a liquid such as ammonia, water or a mixture of liquid ammonia and water which dissociate(s) into a mixture of light gases upon detonation of the shaped charge. The design has elements that would lend itself to large guns such as artillery or naval guns, but would still be difficult to transition to a man-portable weapon. In addition, the corrosive nature of anhydrous ammonia or water would create severe wear within the breech, making the fielded system unreliable and decreasing maintainability.

Mcdermott, U.S. Pat. No. 7,775,148, proposes launching payloads at high velocity uses high-pressure gas or combustion products for propulsion, with injection of high pressure gas at intervals along the path behind the payload projectile as it accelerates along the barrel of the launcher. An inner barrel has an interior diameter equal to the projectile diameter or sabot containing the projectile. An outer casing surrounds the inner barrel. Structures at intervals attach the outer casing and the inner barrel. An axial gas containment chamber (AGC) stores high pressure gas between the inner barrel wall, the outer casing wall, and enclosure bulkheads. Pressure-activated valves along the barrel sequentially release the high pressure gas contained in the AGC in to the barrel to create a continuously refreshed high energy pressure heads behind the projectile as it moves down the barrel. A frangible cover at the exit end of the barrel allows the barrel to be evacuated prior to launch. The launcher is rapidly recyclable. The valves close automatically after the projectile has exited the barrel, allowing a new projectile to be introduced into the breech and the AGC to be recharged with high-pressure gas. The system is designed as a launch system that can be rapidly reconfigured for launch. The complexity of the system and the necessity of evacuating the barrel preclude its use as a fieldable weapon system.

Kremeyer, U.S. Pat. No. 8,141,811; proposes modifying a shock wave in a gas by emitting energy to form an extended path in the gas; heating gas along the path to form a volume of heated gas expanding outwardly from the path; and directing a path. The volume of heated gas passes through the shock wave and modifies the shock wave. This eliminates or reduces a pressure difference between gas on opposite sides of the shock wave. Electromagnetic, microwaves and/or electric discharge can be used to heat the gas along the path. This application has uses in reducing the drag on a body passing through the gas, noise reduction, controlling amount of gas into a propulsion system, and steering a body through the gas. An apparatus is also disclosed. The solution requires considerable hardware be added to the projectile, making it unsuitable for a small caliber round. The energy and resultant energy generation or storage required to drive the emitters also outweighs any benefit derived from the reduction in drag.

None of the systems described in the prior art is adaptable to a man-carried weapon system. Each has limitations that preclude sustained rates of fire, light weight, and the simplicity and reliability necessary for a weapon system.

SUMMARY OF THE INVENTION

The light gas gun of this invention is a compressed gas weapon or launcher that uses helium or hydrogen as the working fluid. The light gas gun described herein provides a unique and potentially devastating weapon that will provide the operator greater range, superior lethality, more stealth, and ultimately greater survivability than any other weapon of its kind. The gun is designed to provide muzzle velocities greater than any conventional firearm of the same caliber currently in use. The embodiments are capable of firing spin-stabilized and non-spin stabilized projectiles.

The gun of this invention consists of four primary elements: the frictionless barrel assembly, the breech assembly, the muzzle valve assembly, and the light gas that is used as the propellant. The barrel assembly uses gas bearings to minimize projectile assembly contact with the barrel walls. The gas bearings virtually eliminate friction with the barrel, thus greatly reducing barrel wear. Given the substantially increased muzzle velocities capable with a light gas gun, this is an enabling feature.

The breech assembly includes the trigger valve, a receiver locking bolt 17, used in loading the round, the breech where the projectile is held prior to firing the gun, and a means of providing high pressure light gas propellant. Propellant can be provided by any number of means, including a simple reservoir, or using mechanically, combustion, or gas driven pistons.

Each of the embodiments of this invention incorporates a means of firing the weapon with the barrel filled with light gas. This creates an environment where the internal ballistics of the gun are governed by the properties of the light gas. Because the speed of sound is substantially higher for light gases, all the internal ballistics are subsonic, greatly increasing efficiency of the gun. This is accomplished by either purging the gun barrel with light gas immediately prior to firing the gun or by continually maintaining a positive light gas pressure in the gun using a muzzle valve assembly. By using the muzzle valve assembly, the majority of propellant gases can be routed through a suppression canister, reducing the acoustic signature of the gun.

All of these elements combined enable a gun that can be adapted to use as a very powerful handgun, a sniper rifle with exceptional performance, artillery with extreme range, a naval gun uniquely adapted to surface warfare, or even an orbital launch system that eliminates the first stage booster.

The fourth embodiment of this invention enables a sniper rifle with a muzzle velocity 30 percent greater than weapons currently in use with no muzzle flash and an acoustic signature of less than 80 db. This would provide stealth to special operations soldiers and snipers. In addition, the projectile assembly would increase the range of the weapon system by more than 50 percent.

When scaled up to artillery or naval guns, the same benefits would apply. Increased muzzle velocity and range would put artillery well behind the forward edge of battle, beyond counterbattery fire. The reach of naval guns would enable longer standoff distances or enable naval guns to reach targets well beyond standard naval guns. The reduced acoustic signature would reduce the acoustic hazard associated with large guns.

The invention can also be used to accelerate a rocket and it's payload, eliminating the first stage booster. Such a scheme would eliminate refurbishment of the launch pad, could be reconstituted in hours, as well as eliminating the expense of the first stage booster.

OBJECT OF THE INVENTION

The first object of this invention is to improve efficiency by using a light gas atmosphere in the barrel in front of the projectile, reducing the energy required to propel the projectile out of the barrel.

A second object of this invention is to improved efficiency by using a gas bearing in the barrel wall to virtually eliminate friction in the barrel, eliminating barrel wear, and reducing the requirement for high peak pressures in the barrel.

A third object of this invention is to increased muzzle velocities by using light gas as a propellant in a gun that can be made man-portable.

A fourth object of this invention is to reduce the acoustic signature of the light gas gun to levels well below those of conventional firearms.

A fifth object of this invention is to increase the range of the gun by significantly increasing the muzzle velocity of the gun as compared to conventional firearms.

A sixth object of this invention is to increase the energy on target for a given range, as compared to comparable firearms.

A seventh object of this invention is to improve reliability of the gun by reducing possible outside contaminants such as dirt and sand from entering the gun.

A eighth object of this invention is to increase accuracy of the gun by eliminating second and third order effects that impact standard firearms.

A final object of this invention is to reduce the muzzle flash by using a non-combusted light gas as a propellant.

DETAILED DESCRIPTION OF THE INVENTION

Definitions

Figure 1A:
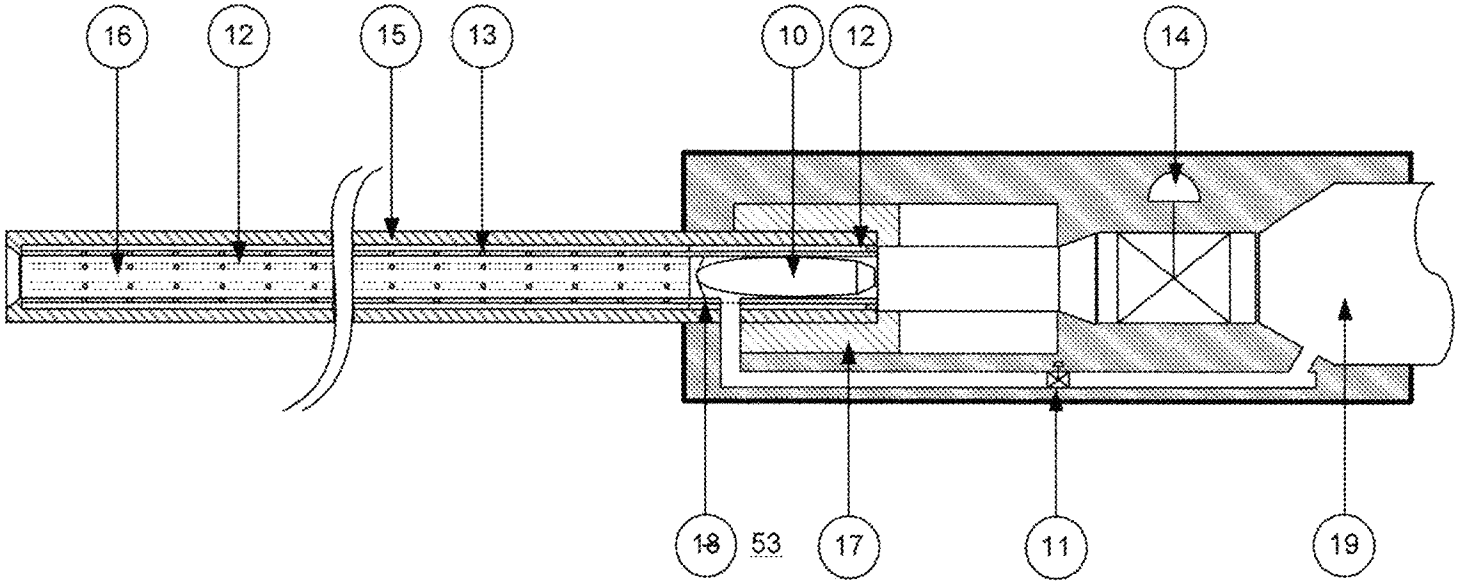
FIGS. 1A and 1C Embodiments of the Light Gas Gun

Barrel Assembly. A two piece barrel made up of an inner tube and an outer tube. The inner tube is press fit into the outer tube and has channels cut into the outer diameter of the inner tube and holes drilled in the channels that allow light gas to flow down the barrel and into the interior of the inner tube, acting as gas bearings to keep the round centered in the barrel.

Breech. The cylindrical cavity where the projectile or projectile assembly rests prior to firing the light gas gun.

Breech Assembly. Made up of the breech body, the receiver locking bolt, the trigger valve, a purge/fill valve, and the receiver safety. The breech assembly is mechanically connected to the barrel assembly on the front or muzzle end and to the light gas source in the rear of the breech body.

Breech Assembly Body. The part to which the receiver locking bolt, trigger valve, and light gas source, receiver safety, and barrel assembly are connected. The breech is bored into the breech assembly body and aligned with the barrel assembly.

Channel. Grooves milled into the outside wall of the inner tube to allow light gas to flow the length of the barrel, supplying gas to the gas bearing ports drilled into the bottom of the channels. A plurality of channels spaced radially around the circumference of the tube are milled in the outside wall of the inner tube at angles to create a vortex that imparts spin to the projectile, or normal to the outside wall of the inner tube where spin stabilization is not required.

Gas Bearings. Holes connecting the channels to the inner diameter of the barrel tube, appropriately, spaced the length of the barrel, equally spaced around the circumference of the inner tube, and connected by channels running from the breech end of the inner tube to just shy of the muzzle end of the inner tube. The gas bearings direct high pressure light gas axially inward, toward the round, keeping it centered in the inner tube.

Gas Bearing Port. One of the holes drilled in the inner tube that directs light gas toward the projectile.

Inner Tube. The interior cylinder of the barrel assembly, with channels milled the length of the tube and gas bearing ports drilled at specified distances, centered in the channels.

Leaf Bore. A hole bored in the muzzle valve leaf that allows the round to exit the light gas gun when aligned with the barrel assembly bore and the other muzzle valve leaves.

Light Gas. Elemental helium or molecular hydrogen.

Muzzle Valve. The valve that opens to allow the round to exit the light gas gun and closes to retain unused light gas. The muzzle valve and opposing multi-leaf valve are used interchangeably. The opposing multi-leaf valve is a specific type of muzzle valve.

Muzzle Valve Assembly. Consists of a muzzle valve body, a muzzle valve, a plurality of muzzle vent valves, hydraulic actuators to drive the muzzle valve, and a suppression canister. The assembly seals the light gas gun in order to hold a positive pressure in the breech and barrel. Opens the muzzle valve to allow the round to exit and to vent propellant gases to the atmosphere through the suppression canister. The muzzle valve assembly is mechanically connected to the barrel assembly on the muzzle end.

Muzzle Valve Body. The structure to which all other muzzle valve components are attached.

Muzzle Valve Chamber. The space between the end of the barrel assembly and the muzzle valve where propellant light gas is directed to the muzzle vent valves.

Muzzle Valve Leaf. A component of the specific opposing multi-leaf valve used in embodiments three and four. A plurality of the leaves are used to allow the round to leave the light gas gun when they are hydraulically driven together to align the holes bored in the individual leaves with the bore of the barrel. When hydraulic pressure is released, the leaves are then reset by springs that drive them back into their pre-fire positions, sealing the muzzle.

Muzzle Vent Valve. A small pressure relief valve that opens whenever pressure in the muzzle chamber rises above a predetermined level. The muzzle vent valve vents to the atmosphere through the suppression chamber.

Opposing Multi-Leaf Valve. The specific type of muzzle valve used in the third and fourth embodiments, designed to minimize the impulse imparted to the light gas gun while opening and closing. May be used interchangeably with muzzle valve.

Outer Tube. The exterior cylinder of the barrel assembly. Attached to the breech assembly and, in embodiments three and four, the muzzle valve assembly. The inner tube is press fit into the outer tube.

Projectile. It can be a standard caliber bullet, artillery round, or other specialized round developed exclusively for the light gas gun.

Purge Valve. A valve that is triggered in the firing sequence to put light gas into the front of the breech. The light gas flows long enough to ensure the barrel is clear of air and filled with light gas. The valve closes as the trigger valve opens.

Receiver Locking Bolt. The mechanism that allows a round to be loaded into the breech. It unlocks, moves toward the rear sufficiently far to allow loading of the round, then moves forward after the round is loaded, locks, and seals the breech in preparation for firing.

Receiver Safety. A spring-loaded mechanism that holds the round in place in the breech. It includes a mechanical lock that prevents the round from moving until the firing safety is turned to the fire position. This prevents accidental firing of the round.

Round. Used interchangeably with projectile.

Suppression Canister. A hollow cylinder connected to the muzzle valve assembly that surrounds the barrel assembly and may be connected to the breech assembly. The cylinder contains baffles and flame retardant foam that allows the light gas entering from the muzzle valve assembly to exit to the atmosphere through vent holes in the side of the cylinder, directing the light gas away from the operator. The baffles and the foam reduce the acoustic signature of the light gas gun and help to prevent contaminants from reaching light gas gun mechanisms.

Suppression Vent. The holes drilled into the side of the suppression canister that direct light gases away from the operator.

Trigger Valve. The valve that controls the light gas flow to the rear of the breech. The trigger valve is actuated with the pull of the trigger to allow high pressure light gas to flow for sufficient time to propel the round out of the barrel.

Description

This system description describes four different embodiments of the invention. Each embodiment is representative of different potential applications.

Figure 2A:
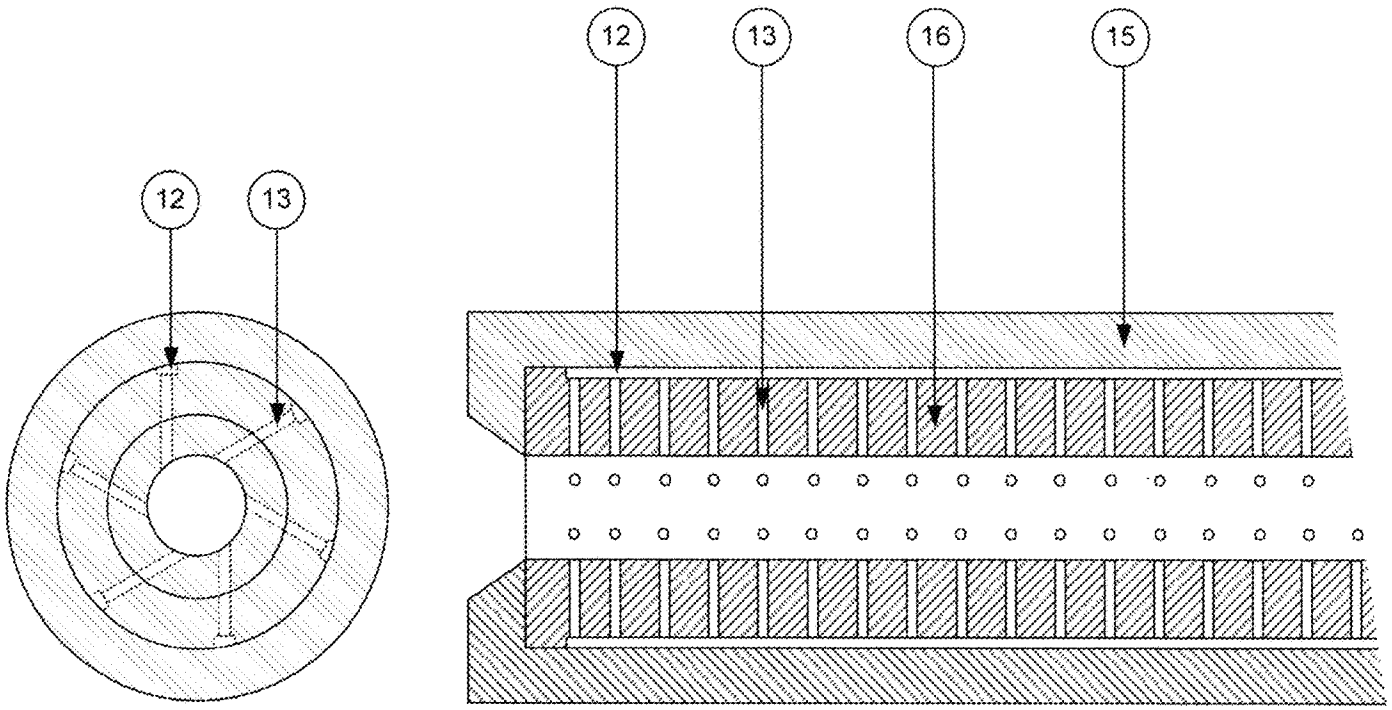
FIGS. 2 A & B Barrel Assembly Detail For Spin-Stabilized and Non-Spin Stabilized Projectiles FIG. 3 Muzzle Valve Assembly Detail FIG. 4 Breech Assembly Detail

The light gas gun of this invention FIGS. 1A/C is a compressed gas gun that uses helium or hydrogen as the working fluid, fires a projectile 10, has a frictionless barrel FIG. 2A/B, and means to fire the round while the barrel contains light gas. Each embodiment shown has a breech assembly FIG. 4 that allows loading of the projectile 10 in preparation for firing the gun, then reloading to enable firing again. All embodiments can be adapted to fire spin stabilized or non-spin stabilized projectiles.

The first embodiment FIG. 1A uses light gas to purge the barrel assembly FIG. 2A/B of air from a light gas source 19, ensuring internal ballistics are subsonic. The first embodiment fires a standard caliber projectile 10. It also includes the frictionless barrel assembly FIG. 2A, which increases efficiency and reduces barrel wear. High pressure light gas is provided to the light gas gun by a simple reservoir through the breech assembly FIG. 4.

The only difference in the second and fourth embodiments is that the gas bearings are drilled normal to the inner wall of the tube and they do not impart spin on the projectile.

There are numerous applications for the different embodiments described herein, including handguns, rifles, ground artillery, naval guns, industrial processes, research, and even orbital launch systems. These different applications might use substantially different methodologies for providing the necessary light gas propellant at the pressures, temperatures, and quantities required, but they all contain the respective elements of the four embodiments. A relatively simple reservoir of light gas large enough to ensure a constant pressure at the firing valve after it is opened might be sufficient for some applications. Others would likely need a two stage piston that could be powered by other pressurized gas, steam, hydraulics or combustive propellants.

First Embodiment

Figure 4:
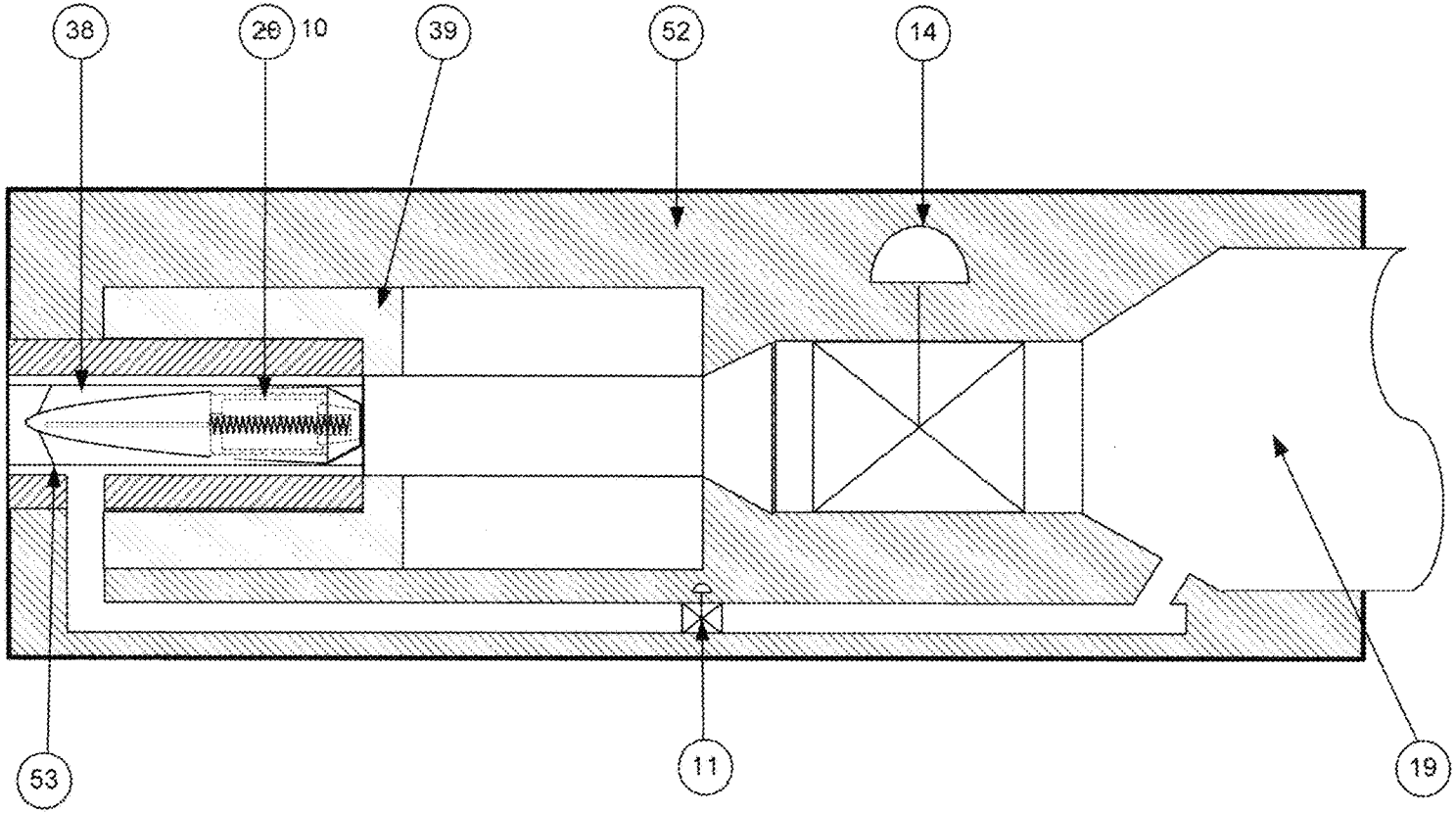

The projectile 10 is loaded into the breech assembly FIG. 4 by opening the receiver locking bolt 17, inserting the projectile 10, then closing and locking the receiver locking bolt 17. With the projectile 10 loaded, the trigger signal is activated, first opening the purge valve 11 for sufficient time to purge the barrel of air and replacing it with light gas, then the trigger valve 14 is opened and the purge valve 11 is closed simultaneously. Light gas entering the breech 38 through the trigger valve 14 from the light gas source 19 propels the projectile 10 down the barrel. A light gas pressure wave also travels the channels 12 on the outside of the inner tube 15 and enters the inner tube 15 through the gas bearing ports 13, creating a vortex in the barrel that imparts a spin on the projectile 10 as it travels down the barrel. The light gas travels the channels 12 faster than the pressure wave behind the projectile 10, allowing the light gas to flow through the gas bearings to impinge upon the projectile 10 and prevent it from contacting the barrel assembly FIG. 2B walls. Because the greatest diameter of the projectile 10 is smaller than the inside diameter of the inner tube 15 by a few thousandths of an inch, there is gas flow between the projectile 10 and the barrel that also helps to keep the round centered in the barrel. The trigger valve 14 closes after a specified time, on the order of a few milliseconds.

Second Embodiment

The second embodiment is identical to the first with one exceptions. The channels 12 and gas bearing ports 13 are cut and drilled normal to outside wall of the inner tube 15, for projectiles that do not require spin stabilization.

The light gas gun's other mechanisms, the frictionless barrel FIG. 2A, the purge and trigger valves 20/14 all operate identically to those in the first embodiment.

Third Embodiment

Figure 2B:
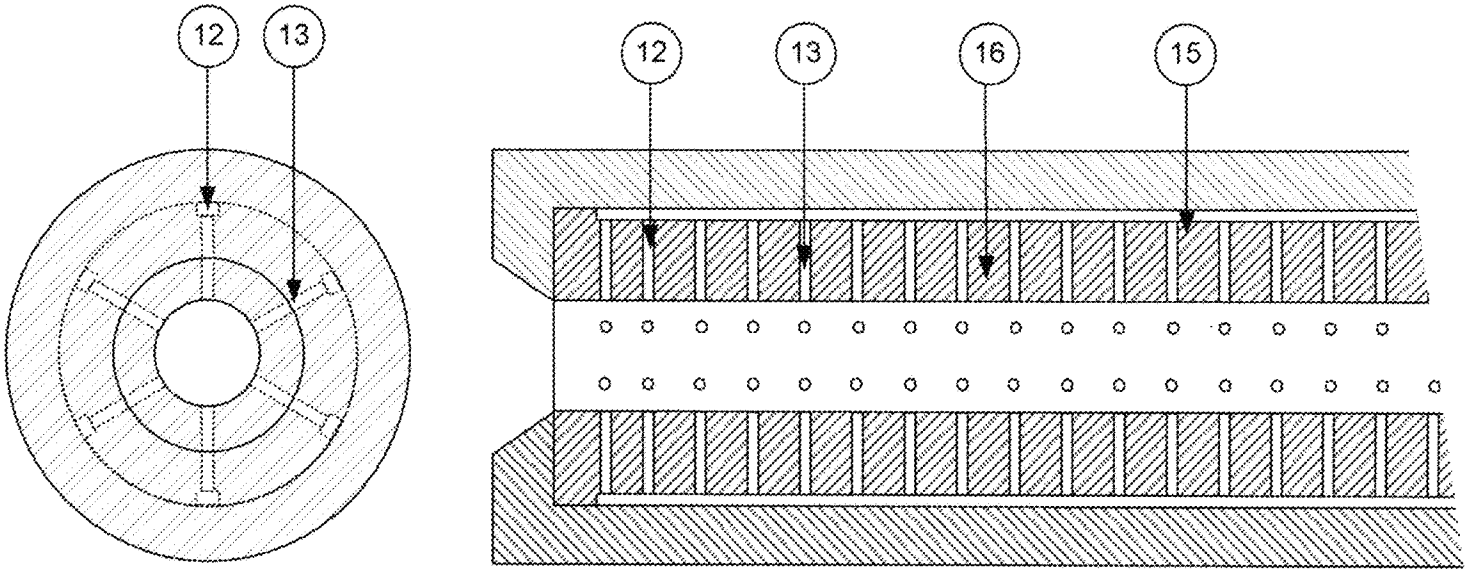
Figure 3:
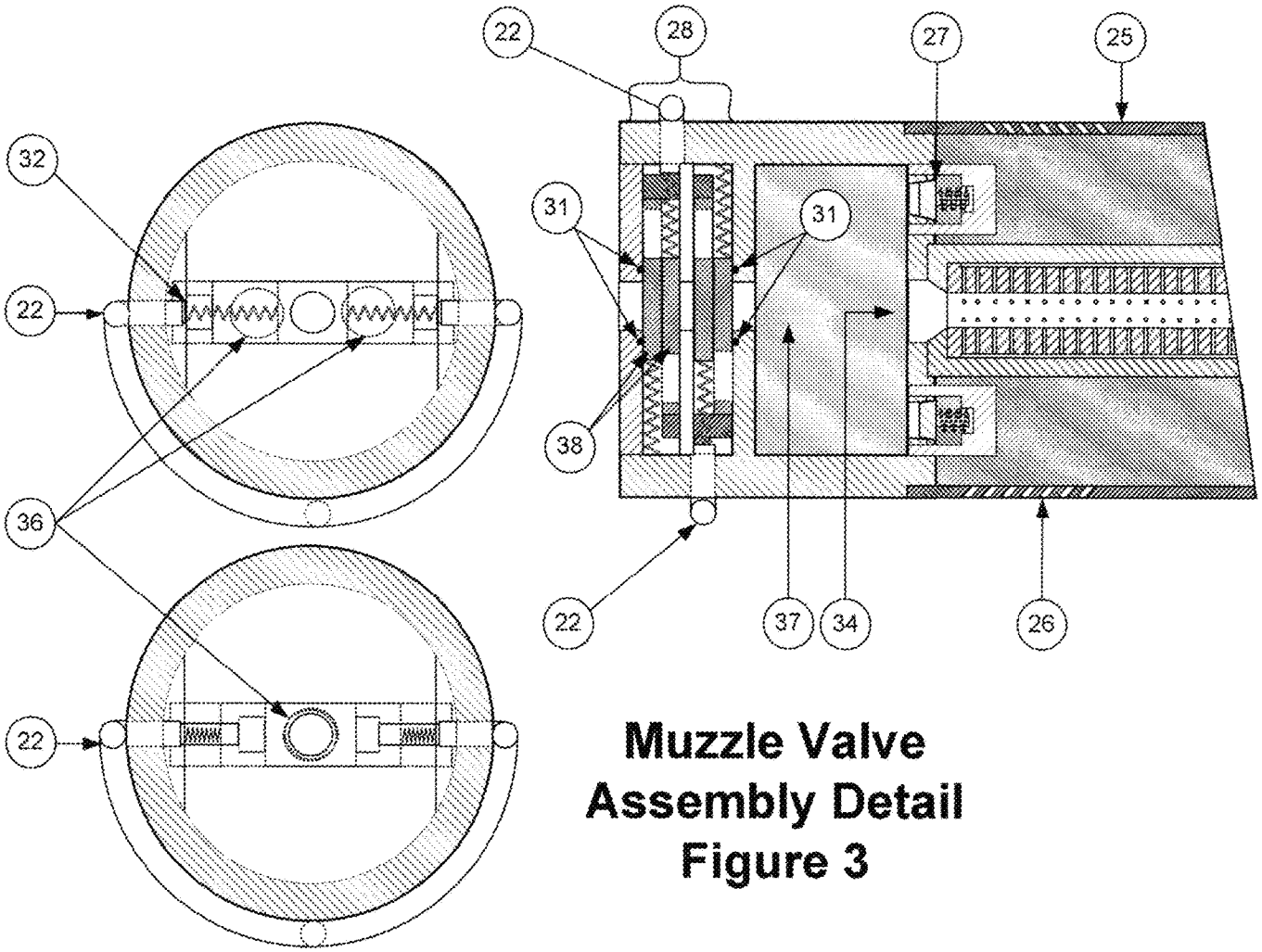

In the third embodiment, the necessity to purge the barrel assembly FIG. 2B is eliminated by adding a muzzle valve assembly FIG. 3 on the muzzle end of the barrel assembly FIG. 2B. The muzzle valve assembly FIG. 3 has an opposing multi-leaf valve 28 that allows the projectile 10 to exit the light gas gun while maintaining a positive pressure in the light gas gun after firing. The muzzle valve assembly FIG. 3 also has a plurality of muzzle vent valves 28 that vent excess pressure through a suppression canister 25 to maintain a fixed positive pressure in the frictionless barrel and breech assemblies FIGS. 2B and 4. Venting excess gas through the suppression chamber 25 significantly reduces the acoustic signature of the light gas gun.

Figure 1C:
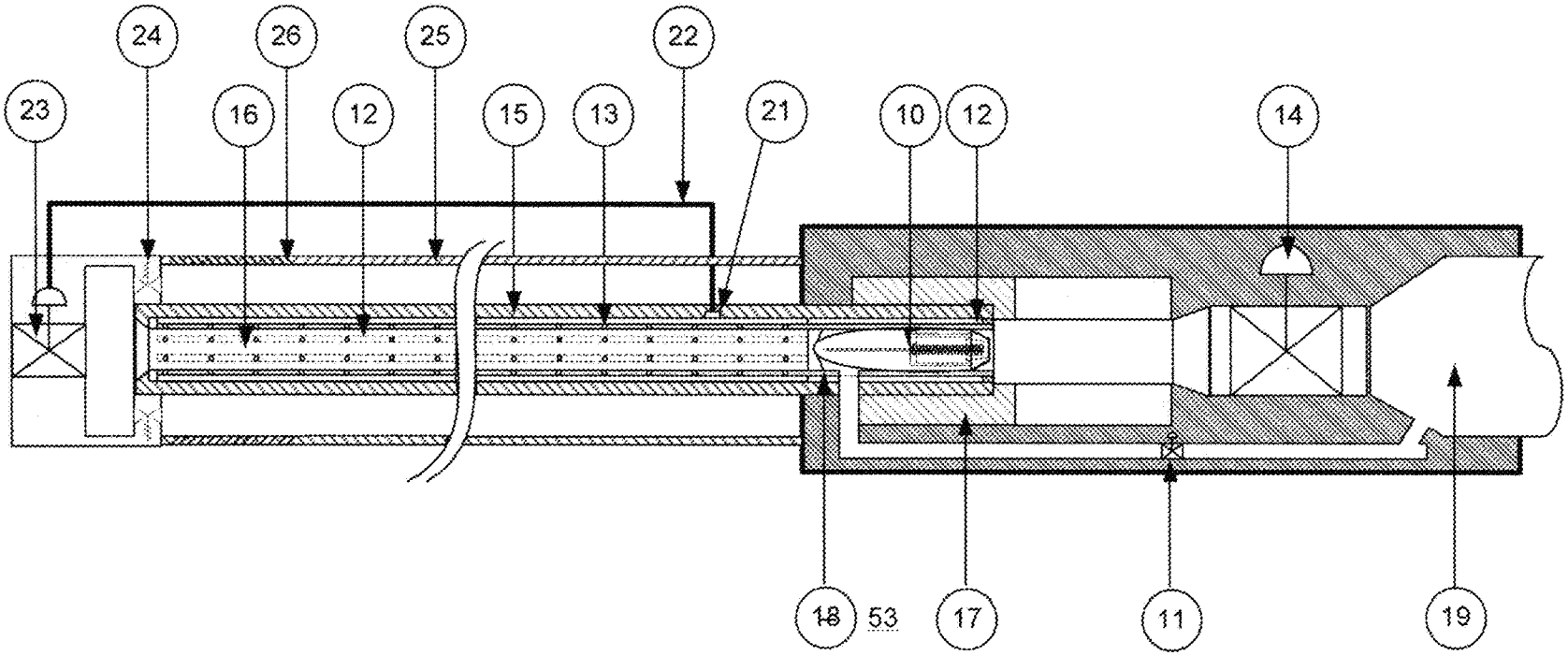

The muzzle valve 23 as shown in FIG. 1C is an opposing multi-leaf valve 28, as shown in FIG. 3, where the actuators 32 move the leaves 38 to a position where the leaf bores 36 align with the barrel assembly bore as shown in FIG. 3B. The muzzle valve 27 is opened by a hydraulic actuator 32 that uses the high pressure light gas behind the projectile 10 to open the opposing multi-leaf valve 28. Springs 25 on the leaves 38 close the valve 23 when the barrel assembly FIG. 2B and muzzle valve chamber 37 pressures equalize. The individual leaf bores 36 are larger than the barrel bore 34. Using the opposing multi-leaf valve 28 ensures that no net impulse is imparted to the light gas gun as the valve opens and closes. The muzzle valve 23 is sealed by the muzzle valve O-rings 31.

As the pressure wave in the barrel assembly FIG. 2B reaches the hydraulic piston 21 and presses against the piston, the hydraulic fluid moves the hydraulic actuator 32 in the muzzle valve assembly FIG. 3 that pushes the opposing leaves of the muzzle valve together, aligning the bores in the muzzle valve leaves 38 with the bore of the barrel 34. The opposing muzzle valve leaves 38 are spring loaded, such that when the pressure in the muzzle valve chamber 37 equalizes with the pressure on the hydraulic actuator 32, the springs 35 close the opposing multi-leaf valve 28.

Fourth Embodiment and Best Mode

The fourth embodiment, offered as the best mode, is identical to the third embodiment, with the exception that the gas bearing ports are drilled normal to wall of the inner tube and does not impart spin on the projectile.

Enablement of the Invention

The barrel assembly FIG. 2A/2B is made up of two concentric tubes, one inside the other. The inner tube 16 bore is greater than the projectile 10 by one to two percent of the projectile diameter to allow travel through the inner tube without touching the walls. Inner and outer tubes 16/15 can be made from chrome moly steel or stainless steel. Because the peak operating pressures are substantially less than a standard firearm, the barrel assembly need not be as robust as a standard firearm.

Channels 12 that allow high pressure gas to travel down the barrel are milled on the outside of the inner tube 16. These channels 12 are small compared to the caliber. The interior tube 16 is press fit into the outer tube 15.

There are two different type valves in the muzzle valve assembly FIG. 3. The muzzle valve 23 is an opposing, multiple-leaf valve 28 located at the muzzle end of the barrel assembly and aligned with the barrel bore 34. The projectile 10 exits the light gas gun through this valve 23. The muzzle valve 23 is a normal fail closed (NFC) valve (i.e., requires hydraulic pressure to open it). A plurality of muzzle vent valves 24 are located at the rear of the muzzle valve assembly housing FIG. 3. These dump the bulk of the high pressure light gas into the suppression canister 25. Roughly 80 percent of the light gas exits through the muzzle vent valves 24.

The suppression canister 25 is a cylindrical canister partially filled with porous, non-flammable, acoustic deadening foam. The canister 25 releases the high pressure light gas into the atmosphere through suppression canister vents 26, while minimizing the acoustic signature caused by the escaping gas. The gas must travel through a series of foam baffles to exit the canister 25. The foam also inhibits dust, dirt, and other particulates from entering the rifle barrel and fouling the valves in the muzzle valve assembly FIG. 3.

The muzzle valve assembly FIG. 3 is mechanically attached to the forward end of the barrel assembly FIG. 2B with a gas-tight seal. The breech end of the barrel assembly FIG. 2B slides into the breech body 52 and is mechanically locked onto the breech body 52 with a gas-tight seal.

The breech assembly FIG. 4 controls the actuation gases and trigger valve 14 timing, loads the projectile 10 into the breech 38, and routes the light gas.

The operator loads the projectile 10 into the breech 38, using the receiver locking bolt 17 to push the round into a loading ramp, then closes and locks the receiver locking bolt 17. The round is held in place by the receiver safety 53, which is a mechanical lock in the breech 38, to keep the round in the correct position in the chamber. This is necessary because the projectile is smaller in diameter than the barrel bore. It also provides spacing to let gas escape should there be a leak in trigger valve 14.

High pressure light gas routed to the breech 38 through the trigger valve 14.

The breech assembly FIG. 4 has a quick connect/disconnect valve (not shown) on the front end of the breech assembly body 52, under the barrel assembly FIG. 2B, to allow connection to sources of light gas.

The breech assembly FIG. 4 also has a mechanism to accept a magazine (not shown) containing the projectile rounds. The magazine is sealed in order to maintain a positive pressure on the projectile rounds to ensure they remain filled with light gas until use. The seal is broken when the magazine is inserted into the breech assembly FIG. 4 and locked in place. Locking the magazine breaks the seal, and light gas purges any residual air out of the system through vents routed to the aft end of the suppression canister 25.

What I claim is:

1. A light gas gun, comprising:

a barrel assembly to receive and guide a projectile, with said barrel assembly further comprised of:

an inner tube with a muzzle end and a breech end, with a plurality of radially spaced channels milled into the outer wall of said inner tube that communicate flow of said light gas from the breech end of the inner tube, with the inner tube further comprising:

a plurality of gas bearing ports extending from said plurality of radially spaced channels through the outer wall into said inner tube, wherein the gas bearing ports communicate flow of said light gas from said plurality of radially spaced channels into said inner tube;

wherein said inner tube inner diameter is slightly larger than said projectile outer diameter;

an outer tube with a muzzle end and a breech end further comprising:

the breech end with a mating surface on the end of said outer tube the muzzle end with a slightly reduced diameter, no more than the thickness of said inner tube wall;

wherein said inner tube is inserted into said outer tube; and a breech assembly further comprised of: a breech assembly body;

a chamber sized and dimensioned for holding said projectile prior to launch, wherein fee said chamber further comprises; a forward section, and and-an opposing rear section; and a receiver safety consisting of a spring loaded mechanism with a minimum of two arms, extending into said chamber, making contact with the forward end of said projectile prior to firing;

a receiver locking bolt that unlocks, moves to the rear of said breech assembly body a sufficient distance to allow said projectile to be loaded, then moves forward after the round is loaded; locks and seals the breech;

a trigger valve that connects a source of light gas to the aft end of said chamber* communicating with and regulating flow between said light gas connection and the rear section of said chamber;

a purge valve that connects the source of said light gas to the forward end of said chamber, communicating with and regulating flow of said light gas with the forward section of said chamber; a triggering mechanism to open said purge and trigger valves;

wherein said outer tube of said barrel assembly is mechanically connected and mates with said breech assembly such that said channels of said inner tube are exposed to and communicate flow of light gas from said chamber to said gas bearing ports.

2. The light gas gun of claim 1 wherein the centerlines of the plurality of gas bearing ports align radially from the channels to the centerline of the frictionless barrel assembly.

3. The light gas gun of claim 1 wherein the centerlines of the plurality of gas bearing ports align from the channels at an angle off of the centerline of the frictionless barrel tube, such that a projectile launching through the frictionless barrel is imparted a rotational force.

4. The light gas gun of claim 1 further comprising:

A muzzle valve assembly mechanically secured to the muzzle end of the frictionless barrel assembly, the muzzle valve assembly comprising:

A muzzle valve temporarily opened by the introduction of high pressure light gas to the breech assembly such that a launched projectile may exit but otherwise closes in order to retain light gas within the frictionless barrel between launchings; and A housing to attach and align said muzzle valve opening with the centerline of the frictionless barrel.

5. The light gas gun of claim 1 further comprising:

a plurality of muzzle vent valves located on the rear of the muzzle valve assembly housing that route high pressure light gas through a suppression canister mechanically attached to the muzzle valve assembly housing.

* * * * *